US006646852B2

(12) United States Patent
Tamai et al.

(10) Patent No.: US 6,646,852 B2
(45) Date of Patent: Nov. 11, 2003

(54) LOAD DRIVING APPARATUS AND DRIVING METHOD OF LOAD CIRCUIT

(75) Inventors: Yasuhiro Tamai, Shizuoka-ken (JP); Tetsuya Hasegawa, Shizuoka-ken (JP); Takashi Gohara, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 151 days.

(21) Appl. No.: 09/987,906

(22) Filed: Nov. 16, 2001

(65) Prior Publication Data

US 2002/0060895 A1 May 23, 2002

(30) Foreign Application Priority Data

Nov. 17, 2000 (JP) ..... 2000-351494

(51) Int. Cl.[7] ..... H01H 9/00

(52) U.S. Cl. ..... 361/160; 361/197

(58) Field of Search ..... 361/160, 195, 361/196, 197

(56) References Cited

U.S. PATENT DOCUMENTS 4,065,805 A * 12/1977 Unterweger et al. ..... 361/196
5,467,248 A * 11/1995 Nishibe ..... 361/170
6,087,893 A * 7/2000 Oowaki et al. ..... 327/537

* cited by examiner

*Primary Examiner*—Anthony Dinkins
(74) *Attorney, Agent, or Firm*—Finnegan, Henderson, Farabow, Garrett & Dunner, L.L.P.

(57) ABSTRACT

A load driving apparatus is provided with a power source (1) applying a power supply voltage, a load circuit (8), a relay circuit (4) electrically connecting the power source (1) to the load circuit (8), a first switching device (2) driving the relay circuit (4), a second switching device (3) having one end connected to the power source (1) and another end connected to the load circuit (8), and supplying the power supply voltage to the load circuit (8), and a control unit (7) outputting a control signal to the second switching device (3) so as to supply the power supply voltage to the load circuit (8) and thereafter outputting a control signal to the first switching device (2) so as to electrically connect the relay circuit (4) to the power source (1), thereby starting driving the load circuit (8).

9 Claims, 5 Drawing Sheets

SW $I_{B2}$ $I_{C2}$ $V_{CE2}$ $I_{B1}$ $I_{RLY}$
$t_1$
$t_2$
$t_3$
$t_4$
$t_{11}$
$t_{12}$

LOAD DRIVING APPARATUS AND DRIVING METHOD OF LOAD CIRCUIT

BACKGROUND OF THE INVENTION

1. Field of the Invention

The present invention relates to a load driving apparatus, for example, for driving a brake, a heater or the like of a vehicle.

2. Description of the Related Art

In recent years, there has been developed a load driving apparatus which intends to increase a specific fuel consumption and improve a performance by increasing a power supply voltage, for example, supplied to a brake, a heater of the like of a vehicle.

The load driving apparatus is provided with an exclusive controller, and is frequently structured such as to drive a load such as a motor or the like via a switching device, for example, a power supply voltage about 14(V), according to a control signal from the controller. The load driving apparatus mentioned above is structured such as to include a relay circuit as the switching device.

However, in the conventional load driving apparatus, in the case of setting the power supply voltage to a high voltage, for example, about 40(V), there is a problem that the relay circuit widely used as the current switching device can not be used in an appropriating manner. There can be listed a generation of an arc due to a high voltage, a long time of an arc time, a deterioration of contact point within the relay circuit due to the arc, and the like.

Accordingly, there can be considered an improvement of the contact point, a prevention of the arc, an improvement by increasing a gap and the like. However, in this case, there is a problem that it is necessary to use a relay circuit in which they are newly improved, and a much cost is required.

SUMMARY OF THE INVENTION

Accordingly, the present invention is proposed by taking the problem mentioned above into consideration, and an object of the present invention is to provide a load driving apparatus which can drive a load with a high voltage by appropriating the conventional load drive as it is.

In order to solve the problem mentioned above, according to the present invention, there is provided a load driving apparatus comprising:

- a power source applying a power supply voltage;
- a load circuit to which the power supply voltage is supplied from the power source, and driving;
- a relay circuit electrically connecting the power source to the load circuit on the basis of a switching operation;
- a first switching device driving the relay circuit so as to execute the switching operation;
- a second switching device having one end connected to the power source and another end connected to the load circuit, and supplying the power supply voltage to the load circuit; and
- a controller outputting a control signal to the second switching device so as to supply the power supply voltage to the load circuit and thereafter outputting a control signal to the first switching device so as to electrically connect the relay circuit to the power source, thereby starting driving the load circuit.

In the load driving apparatus according to the present invention, it is desirable that the controller outputs the control signal to the first switching device so as to cancel the electric connection between the relay circuit and the power source at a time of stopping driving the load circuit after starting driving the load circuit, and thereafter outputs the control signal to the second switching device so as to stop supplying the power to the load circuit.

In the load driving apparatus according to the present invention, the structure may be made such that the controller is provided with a timer counting a predetermined time, supplies the power supply voltage to the load circuit, electrically connects the relay circuit to the power source after the predetermined time counted by the timer elapses, cancels the electric connection between the relay circuit and the power source, and stops supplying the power to the load circuit after the predetermined time counted by the timer elapses.

In the load driving apparatus according to the present invention, the structure may be made such that the controller is provided with a voltage monitor for monitoring a voltage applied to the second switching device, supplies a power supply voltage to the load circuit and electrically connects the relay circuit to the power source after it is judged that the voltage monitored by the voltage monitor becomes greater than a predetermined value.

The structure may be made such that the load driving apparatus according to the present invention is further provided with a rising edge detecting timer circuit inputting an on signal from the controller and outputting an off signal for a predetermined time, an AND circuit to which a control signal from the controller and an output signal from the rising edge detecting timer circuit are input, a falling edge detecting timer circuit outputting an off signal for a predetermined time, and a NAND circuit to which the control signal from the controller and an output signal from the falling edge detecting timer circuit are input, the first switching device switches the relay circuit in response to an output signal from the AND circuit, and the second switching device applies a power supply voltage to the relay circuit in response to an output signal from the NAND circuit.

In order to solve the problem mentioned above, according to the present invention, there is provided a method of driving a load circuit in a load driving apparatus comprising:

- a power source applying a power supply voltage;
- a load circuit to which the power supply voltage is supplied from the power source, and driving;
- a relay circuit electrically connecting the power source to the load circuit on the basis of a switching operation;
- a first switching device driving the relay circuit so as to execute the switching operation; and
- a second switching device having one end connected to the power source and another end connected to the load circuit, and supplying the power supply voltage to the load circuit, wherein the method comprises a step of outputting a control signal to the second switching device so as to supply the power supply voltage to the load circuit and thereafter outputting a control signal to the first switching device so as to electrically connect the relay circuit to the power source, thereby starting driving the load circuit.

In the method of driving the load circuit according to the present invention, it is desirable to output the control signal to the first switching device so as to cancel the electric connection between the relay circuit and the power source at a time of stopping driving the load circuit after starting driving the load circuit, and thereafter output the control signal to the second switching device so as to stop supplying the power to the load circuit.

In the method of driving the load circuit according to the present invention, the structure may be made such that the load driving apparatus is provided with a timer counting a predetermined time, supplies the power supply voltage to the load circuit, electrically connects the relay circuit to the power source after the predetermined time counted by the timer elapses, cancels the electric connection between the relay circuit and the power source, and stops supplying the power to the load circuit after the predetermined time counted by the timer elapses.

In the method of driving the load circuit according to the present invention, the structure may be made such that the load driving apparatus is provided with a voltage monitor for monitoring a voltage applied to the second switching device, supplies a power supply voltage to the load circuit and electrically connects the relay circuit to the power source after it is judged that the voltage monitored by the voltage monitor becomes greater than a predetermined value.

DETAILED DESCRIPTION OF THE PREFERRED EMBODIMENT

Figure 1:
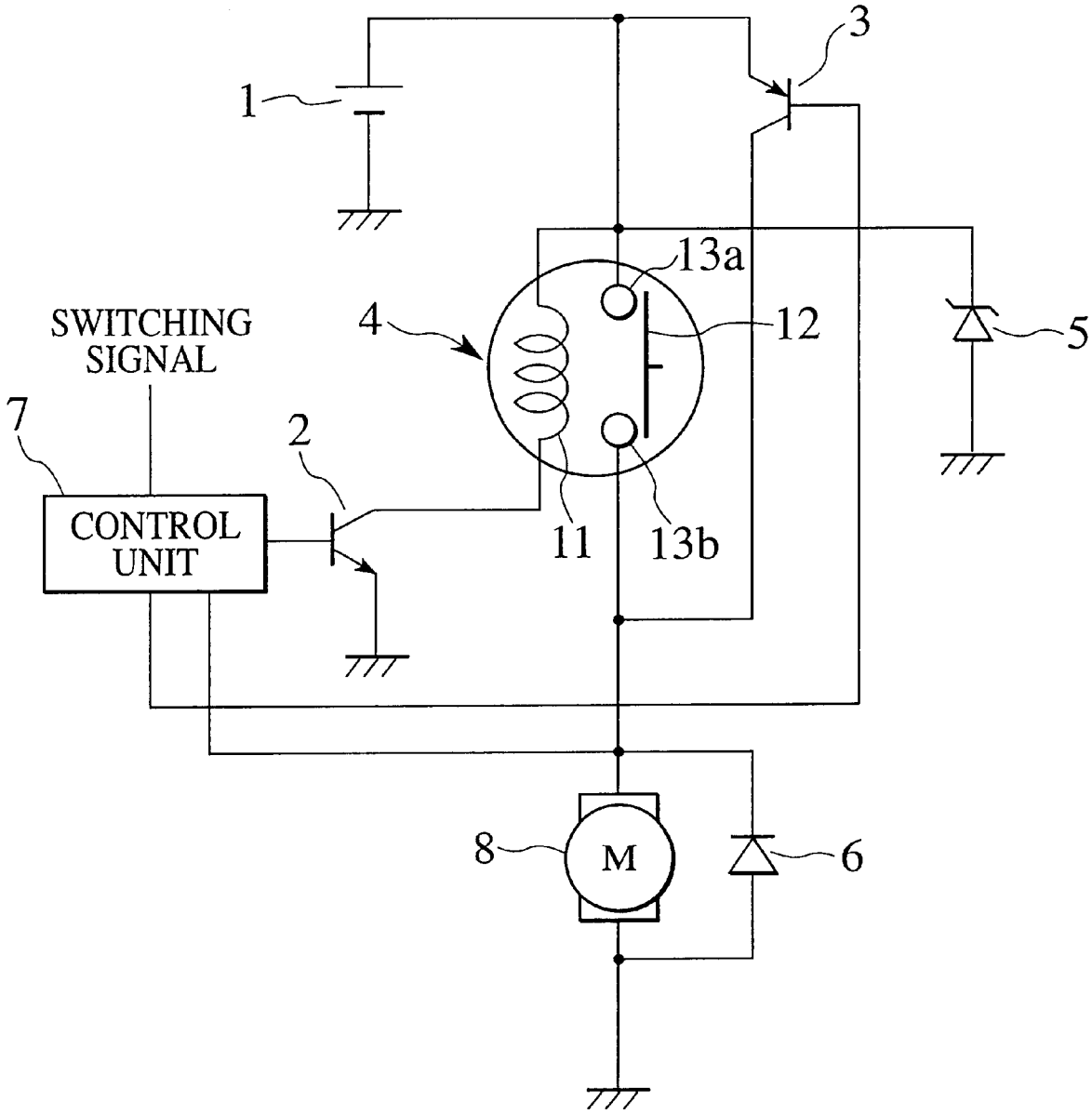
FIG. 1 is a circuit diagram showing a structure of a load driving apparatus to which the present invention is applied.

A description will be given below of an embodiment according to the present invention with reference to the accompanying drawings. The present invention is applied to a load driving apparatus, for example, structured as shown in FIG. 1.

The load driving apparatus is constituted by a power source 1, a first switching device 2, a second switching device 3, a relay circuit 4, a Zener diode 5, a diode 6, a control unit 7 and a load circuit 8.

In this load driving apparatus, the power source 1 is structured such that one end is connected to an earth terminal and another end is connected to the relay circuit 4 and the second switching device 3. The relay circuit 4 is structured such that one end is connected to the second switching device 3 and the power source 1, and another is connected to the load circuit 8 and the second switching device 3. Further, the load circuit 8 is structured such that one end is connected to the relay circuit 4 and the second switching device 3 and another end is connected to an earth terminal.

Further, in this load driving apparatus, the first switching device 2 and the second switching device 3 are structured such that the control unit 7 is connected to a base terminal so as to be controlled on or off according to the control signal from the control unit 7.

The relay circuit 4 is constituted by a coil 11 in which one is connected to the first switching device 2 and another is connected to the Zener diode 5, and an electrically switched switch terminal 12, and the switch terminal 12 is in contact with a terminal 13*a* and 13*b* due to a magnetic field induced by an electric current supplied to the coil 11 so as to electrically connect between the terminal 13*a* and the terminal 13*b*. Therefore, in the load driving apparatus, the power supply voltage supplied by the power source 1 is applied to the load circuit 8 so as to drive the load circuit 8.

A switch signal which indicates starting driving the load circuit 8 or stopping driving the load circuit 8 is input to the control unit 7, and the control unit 7 outputs a control signal to the first switching device 2 and the second switching device 3 according to the switch signal so as to control the relay circuit 4, thereby starting driving the load circuit 8 or stopping driving the load circuit 8.

The control unit 7 stores a program for starting driving the load circuit 8 and stopping driving the load circuit 8 in an inner portion thereof, and controls by a software each of portions constituting the load driving apparatus according to the program. In particular, the control unit 7 executes any one software control among a timer type control of driving and controlling the load circuit 8 according to a timer turning the second switching device 3 in an on state and next turning the first switching device 2 in an on state, and a voltage monitoring type control of monitoring a collector voltage of the second switching device 3 and next turning the first switching device 2 in an on state so as to drive and control the load circuit 8.

Next, in the load driving apparatus, a description will be given of a processing procedure of the control unit 7 at a time of executing the timer type control with reference to FIG. 2.

Figure 2:
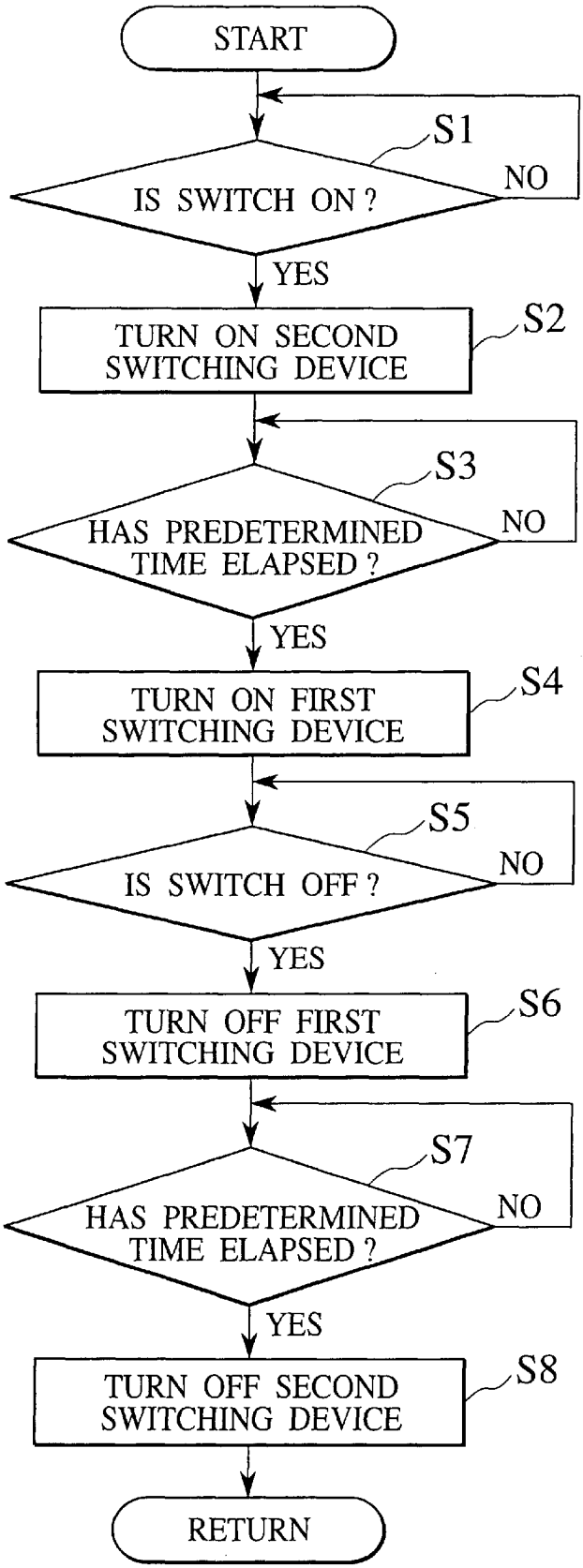
FIG. 2 is a flow chart showing a processing procedure of a control unit at a time of executing a timer type control in the load driving apparatus to which the present invention is applied.

According to FIG. 2, at first, the control unit 7 judges whether or not the switch signal in an on state for starting driving the load circuit 8 is input from an external portion (step S1), and when judging that the signal is input, the control unit 7 outputs the control signal in an on state to a base terminal of the second switching device 3 so as to turn the second switching device 3 in an on state (step S2).

Next, the control unit 7 starts the built-in timer after turning the second switching device 3 in an on state, and when judging that a predetermined time has elapsed after turning the second switching device 3 in an on state (step S3), the control unit 7 outputs the control signal in an on state to the base terminal of the first switching device 2 so as to turn the first switching device in an on state (step S4).

In this case, a normal rising time of the relay circuit 4 generates a chattering since the relay circuit 4 electrically relays due to a mechanical connection among the switch terminal 12, the terminal 13*a* and the terminal 13*b*. The rising time of the relay circuit 4 at a time when the chattering is generated largely varies on the basis of a magnitude of a load current, a load voltage, a current supplied to the coil 11 or the like, however, requires about some hundreds $\mu$s. In this case, since the time is some hundreds $\mu$s by itself, the user can use without sense of discomfort by turning the first switching device 2 in an on state behindhand after a desired time about some tens $\mu$s corresponding to about 10% thereof. For example, in the case that the load circuit 8 is a lamp, since a time about 10 ms is required until the lamp actually turns on, a period after an on time of the second switching device 3 before an on time of the first switching device 2 may be set to be further longer period of some hundreds $\mu$s. In this case, by replacing the timer embedded in the control unit 7 in correspondence to a kind of the load circuit 8, it is possible to change the period after the on time of the second switching device 3 before the on time of the first switching device 2.

Next, the control unit 7 judges whether or not the switch signal in an off state of stopping driving the load circuit 8 is input from the external portion (step S5), and when judging that it is input, the control unit 7 outputs the control signal in an off state to the base terminal of the first switching device 2 so as to turn the first switching device 2 in an off state (step S6).

Next, the control unit 7 starts the embedded timer after turning the first switching device 2 in an off state, and when judging that a predetermined time has elapsed after turning the first switching device 2 in an off state (step S7), the control unit 7 outputs the control signal in an off state to the base terminal of the second switching device so as to turn the second switching device 3 in an off state (step S8). Accordingly, the control unit 7 controls to start and stop driving the load circuit 8.

Next, a description will be given of a state of each of portions at a time of executing the process mentioned above with reference to FIG. 3.

Figures 3A, 3B, 3C, 3D, 3E, 3F:
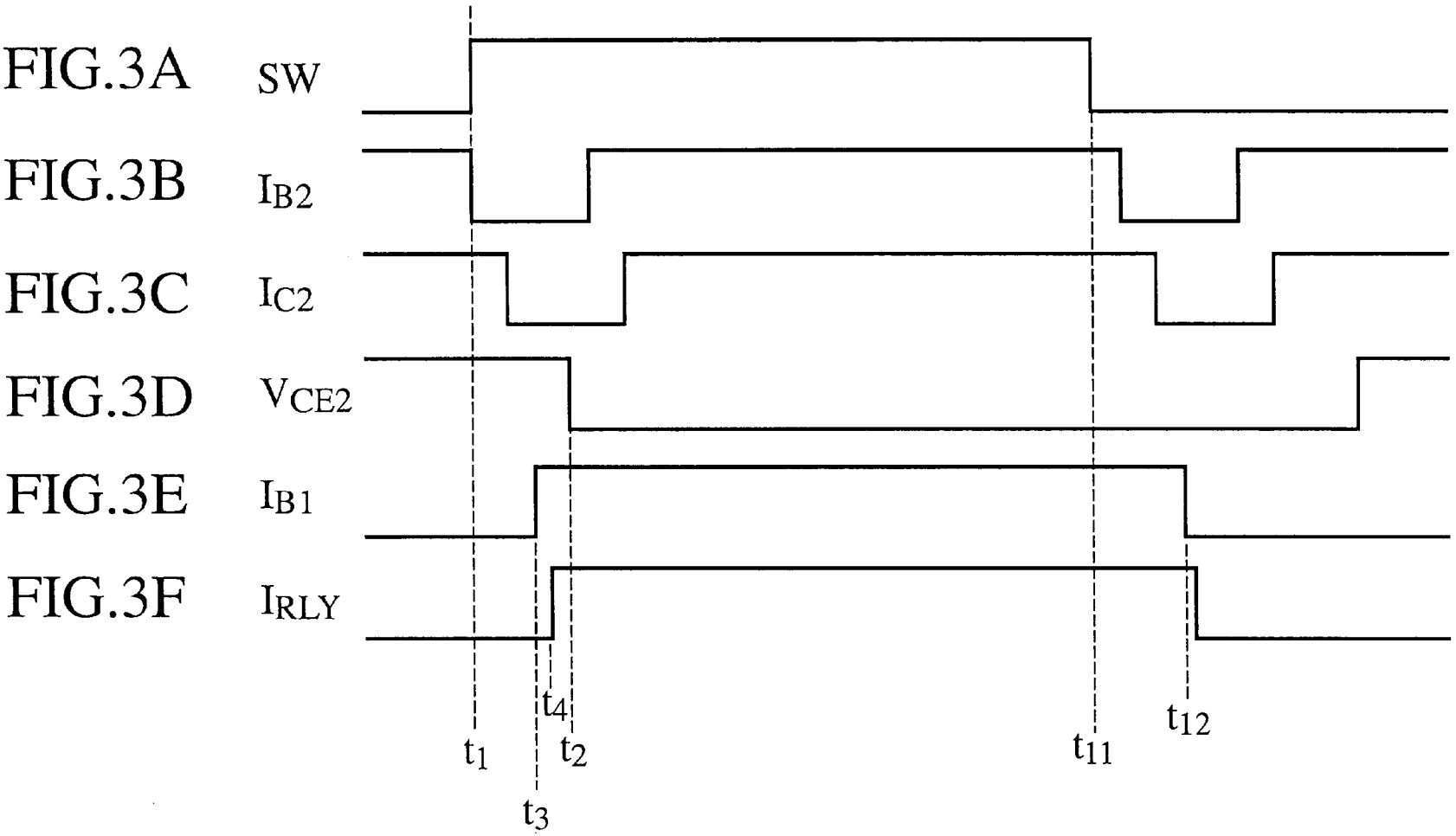
FIG. 3 is a time chart showing a state of signal in each of portions in the load driving apparatus to which the present invention is applied.

According to FIG. 3, at first when the switch signal in an on state is input to the control unit 7 at a time t1 (FIG. 3A), the control unit 7 inputs a control signal IB2 in an on state to the base terminal of the second switching device 3 (FIG. 3B), next a collector current IC2 of the second switching device 3 becomes in an on state (FIG. 3C), and a voltage VCE2 between a collector and an emitter becomes in an on state at a time t2 (FIG. 3D). In this case, the control unit 7 supplies a control signal in an on state to the base terminal of the first switching device 2 at a time t3 in response to an elapse of the period designated by the embedded timer (FIG. 3E), the switch terminal 12 of the relay circuit 4 is connected to the terminal 13*a* and the terminal 13*b* at a time t4 so as to be turned in an on state (FIG. 3F), and the power supply voltage is applied to the load circuit 8.

At this time, since the first switching device 2 is turned in an on state and the relay circuit 4 is turned in an on state in a state that the relay circuit 4 and the second switching device 3 are connected to the power source 1 in parallel and the second switching device 3 becomes in an on state, an electric current of substantially 0V is applied to a contact point between the terminal 13*a* and the terminal 13*b*, so that it is possible to restrict a generation of an arc and it is possible to drive the load with a high voltage while appropriating the conventional load drive as it is.

Further, when the switch signal in an off state is input to the control unit 7 at a time t11 (FIG. 3A), at a time of stopping driving the load circuit 8, the control unit 7 turns the second switching device 3 in an off state (FIG. 3B), shuts off the relay circuit 4, and turns off the first switching device 2 at a time t12 after a predetermined time has elapsed (FIG. 3E), thereby making it possible to avoid an arc and drive the load with a high voltage while appropriating the conventional load drive as it is.

Next, in the load driving apparatus, a description will be given of a processing procedure of the control unit 7 at a time of executing the voltage monitoring type control with reference to FIG. 4. In this case, the same step numbers are attached to the same processes, as the processes shown in FIG. 2 and a detailed description thereof will be omitted.

Figure 4:
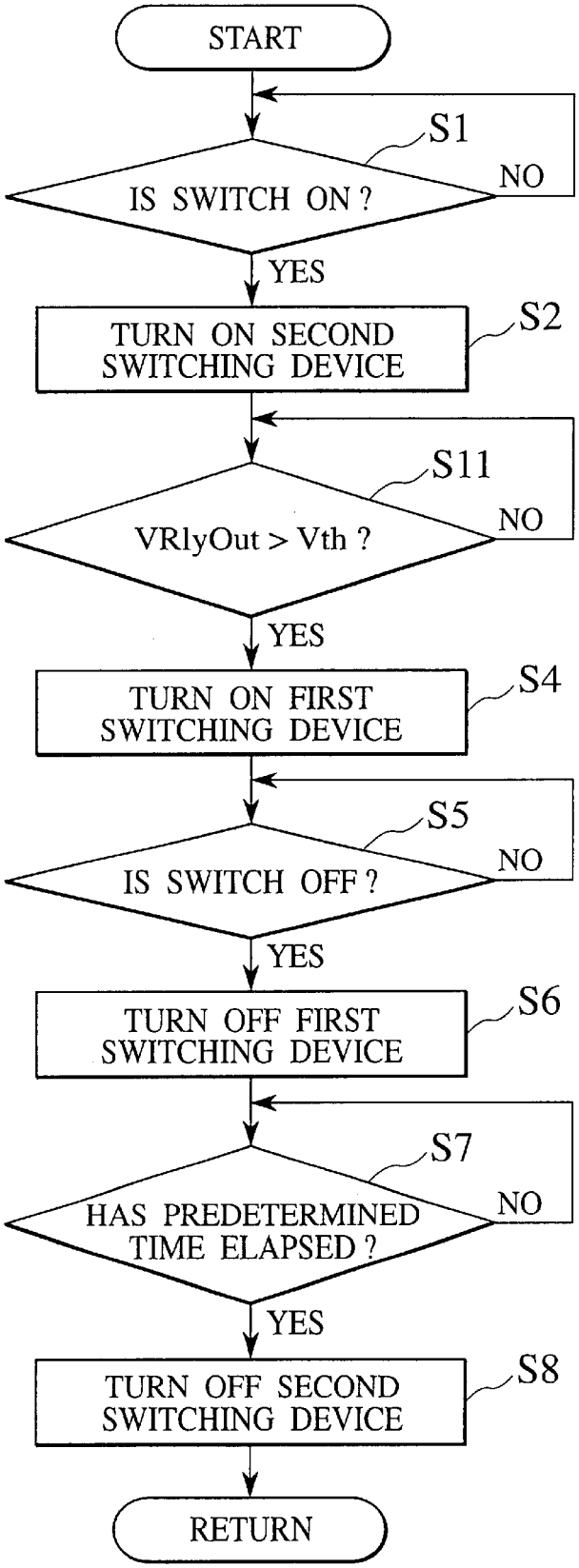
FIG. 4 is a flow chart showing a processing procedure of a control unit at a time of executing a voltage monitoring type control in the load driving apparatus to which the present invention is applied.

According to FIG. 4, at first, the control unit 7 turns the second switching device 3 in an on state (step S2) when the switch signal in an on state for starting driving the load circuit 8 is input from an external portion (step S1).

Next, the control unit 7 reads in a collector voltage VRlyOut of the second switching device 3 by an A/D converter after turning the second switching device 3 in an on state so as to monitor it, compares whether the collector voltage VRlyOut is larger than a predetermined voltage Vth, and when judging that the collector voltage VRlyOut becomes larger than the predetermined voltage Vth (step S11), the control unit 7 turns the first switching device 2 in an on state (step S4).

Further, the control unit 7 turns the first switching device 2 in an off state (step S6) when the switch signal in an off state of stopping driving the load circuit 8 is input from the external portion (step S5), and when judging that a predetermined time has elapsed after turning the second switching device 3 in an off state (step S7), the control unit 7 turns the second switching device 3 in an off state (step S8). Accordingly, the control unit 7 controls to start and stop driving the load circuit 8.

According to the load driving apparatus provided with the control unit 7 executing the processes mentioned above, since the second switching device 3 is turned in an on state, the first switching device 2 is turned in an on state and the relay circuit 4 is turned in an on state, an electric current of substantially 0V is applied to a contact point between the terminal 13*a* and the terminal 13*b*, so that it is possible to restrict a generation of an arc.

Further, in this load driving apparatus, when the switch signal in an off state is input at a time of stopping driving the load circuit 8, the control unit 7 turns the second switching device 3 in an off state, shuts off the relay circuit 4, and thereafter turns off the first switching device 2, thereby making it possible to avoid an arc.

Next, a description will be given of another example of a load driving apparatus to which the present invention is applied with reference to FIG. 5.

Figure 5:
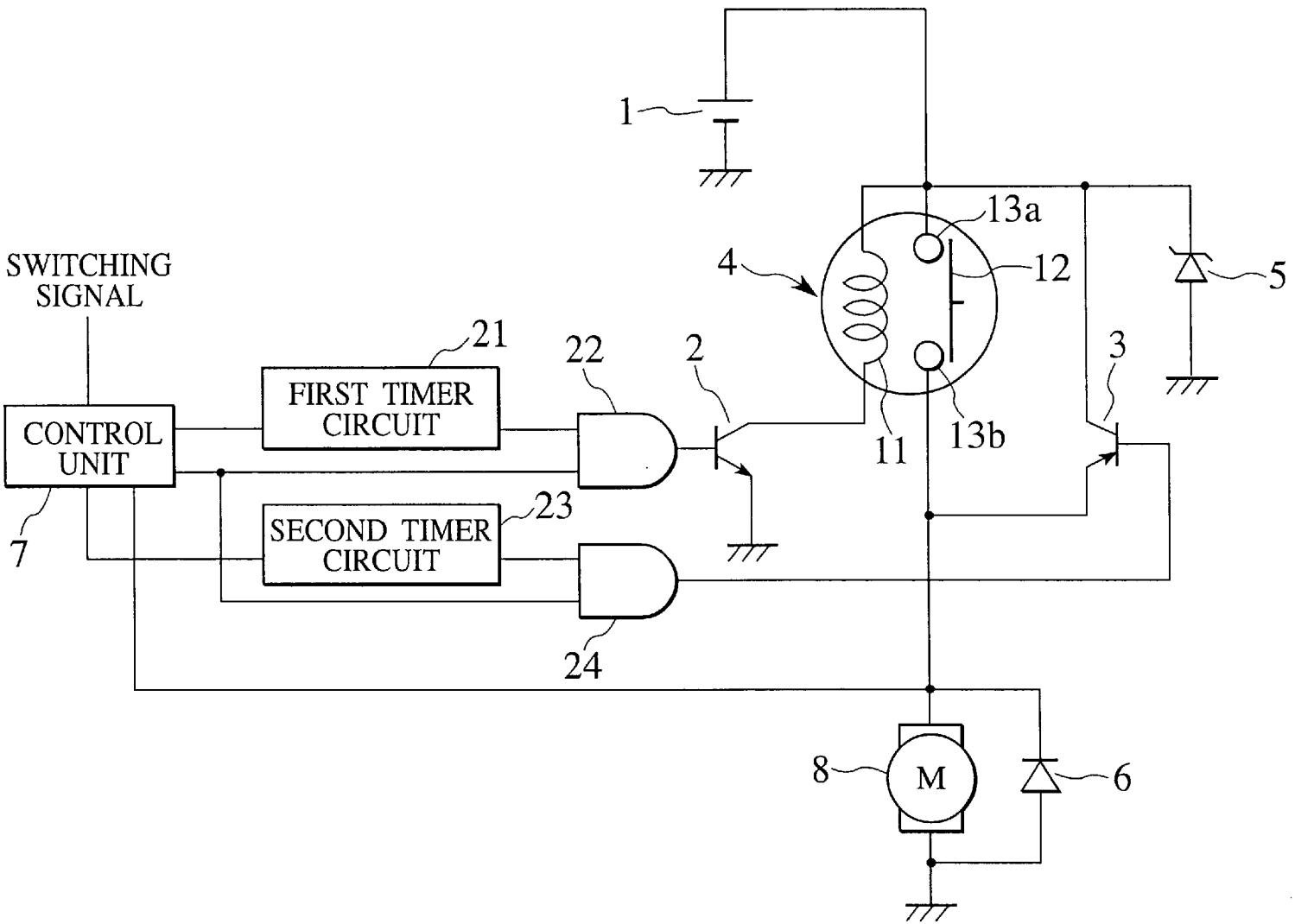
FIG. 5 is a circuit diagram showing another structure of a load driving apparatus to which the present invention is applied.

In the load driving apparatus shown in FIG. 5, the structure is made such that a first timer circuit 21 and an AND circuit 22 are arranged between the control unit 7 and the first switching device 2, and a second timer circuit 23 and a NAND circuit 24 are arranged between the control unit 7 and the second switching device 3. In this load driving apparatus, the control unit 7 controls by a software each of portions constituting the load driving apparatus according to the program. In particular, the control unit 7 executes any one software control among a timer type control of driving and controlling the load circuit 8 according to a timer turning the second switching device 3 in an on state and next turning the first switching device 2 in an on state, and a voltage monitoring type control of monitoring a collector voltage of the second switching device 3 and next turning the first switching device 2 in an on state so as to drive and control the load circuit 8.

In the load driving apparatus mentioned above, at a time of executing the timer type control, a control signal from the control unit 7 and a signal indicating a logical product from the first timer circuit 21 are input from the AND circuit 22 to the first switching device 2. The first timer circuit 21 is normally turned on and outputs an off signal for a predetermined time in response to a rising of the control signal from the control unit 7.

Accordingly, even when the control signal from the control unit 7 becomes in an on state, the first switching device 2 does not turn in an on state during a period that the off signal is input from the first timer circuit 21. When the on signal after the off signal for the predetermined time is input to the AND circuit 22, the first switching device 2 turns in an on state behindhand.

Further, in this load driving apparatus, at a time of executing the voltage monitoring type control, the collector voltage of the second switching device 3 is monitored, and it is possible to recognize that the collector voltage becomes 0V at a time when the control signal from the control unit 7 is in an off state, and is increased to about the power supply voltage at a time when it is in an on state. Accordingly, in the load driving apparatus, it is possible to recognize that the second switching device 3 becomes in an on state so as to turn the first switching device 2 in an on state, thereby starting and stopping driving the load circuit 8.

According to the present example, in order to estimate a change of the power supply voltage, the structure is made such that the power supply voltage is separated so as to invert the output value from the A/D comparator at a slightly lower value than the power supply voltage.

In the load driving apparatus, in the case of turning the load circuit 8 in an off state, after turning off the first switching device 2 in the same manner as that of the timer type control, the second switching device 3 is turned in an off state behindhand at a period set by the second timer circuit 23.

What is claimed is:

1. A load driving apparatus comprising:

a power source applying a power supply voltage;

a load circuit to which the power supply voltage is supplied from the power source, and driving;

a relay circuit electrically connecting the power source to the load circuit on the basis of a switching operation;

a first switching device driving the relay circuit so as to execute the switching operation;

a second switching device having one end connected to the power source and another end connected to the load circuit, and supplying the power supply voltage to the load circuit; and a controller outputting a control signal to the second switching device so as to supply the power supply voltage to the load circuit and thereafter outputting a control signal to the first switching device so as to electrically connect the relay circuit to the power source, thereby starting driving the load circuit.

2. A load driving apparatus according to claim 1, wherein the controller outputs the control signal to the first switching device so as to cancel the electric connection between the relay circuit and the power source at a time of stopping driving the load circuit after starting driving the load circuit, and thereafter outputs the control signal to the second switching device so as to stop supplying the power to the load circuit.

3. A load driving apparatus according to claim 1, further comprising a timer counting a predetermined time, wherein the controller supplies the power supply voltage to the load circuit, electrically connects the relay circuit to the power source after the predetermined time counted by the timer elapses, cancels the electric connection between the relay circuit and the power source, and stops supplying the power to the load circuit after the predetermined time counted by the timer elapses.

4. A load driving apparatus according to claim 1, the controller having a voltage monitor monitoring a voltage applied to the second switching device, wherein the controller supplies a power supply voltage to the load circuit and electrically connects the relay circuit to the power source after it is judged that the voltage monitored by the voltage monitor becomes greater than a predetermined value.

5. A load driving apparatus according to claim 1, further comprising:

a rising edge detecting timer circuit inputting an on signal from the controller and outputting an off signal for a predetermined time;

an AND circuit to which a control signal from the controller and an output signal from the rising edge detecting timer circuit are input;

a falling edge detecting timer circuit outputting an off signal for a predetermined time; and a NAND circuit to which the control signal from the controller and an output signal from the falling edge detecting timer circuit are input, wherein the first switching device switches the relay circuit in response to an output signal from the AND circuit, and the second switching device applies a power supply voltage to the relay circuit in response to an output signal from the NAND circuit.

6. A method of driving a load circuit in a load driving apparatus comprising:

a power source applying a power supply voltage;

a load circuit to which the power supply voltage is supplied from the power source, and driving;

a relay circuit electrically connecting the power source to the load circuit on the basis of a switching operation;

a first switching device driving the relay circuit so as to execute the switching operation; and a second switching device having one end connected to the power source and another end connected to the load circuit, and supplying the power supply voltage to the load circuit, comprising the steps of:

outputting a control signal to the second switching device so as to supply the power supply voltage to the load circuit;

outputting a control signal to the first switching device so as to electrically connect the relay circuit to the power source; and starting driving the load circuit on the basis of the two steps.

7. A method of driving a load circuit according to claim 6, wherein the method comprises a step of outputting the control signal to the first switching device so as to cancel the electric connection between the relay circuit and the power source at a time of stopping driving the load circuit after the step of starting driving the load circuit, and a step of outputting the control signal to the second switching device so as to stop supplying the power to the load circuit after the step of canceling the electric connection.

8. A method of driving a load circuit according to claim 6, the load driving apparatus being provided with a timer counting a predetermined time, wherein the method comprises a step of supplying the power supply voltage to the load circuit, a step of electrically connecting the relay circuit to the power source after the predetermined time counted by the timer elapses, and a step of canceling the electric connection between the relay circuit and the power source, and stopping supplying the power to the load circuit after the predetermined time counted by the timer elapses.

9. A method of driving a load circuit according to claim 6, the load driving apparatus being provided with a voltage monitor monitoring a voltage applied to the second switching device, wherein the method comprises a step of supplying a power supply voltage to the load circuit so as to judge that the voltage monitored by the voltage monitor becomes greater than a predetermined value, and a step of electrically connecting the relay circuit to the power source after the judging step.

* * * * *